US010662746B2

(12) United States Patent
Jackson

(10) Patent No.: US 10,662,746 B2
(45) Date of Patent: May 26, 2020

(54) PLUNGER SLEEVE FOR ARTIFICIAL LIFT SYSTEMS

(71) Applicant: Matthew S. Jackson, Houston, TX (US)

(72) Inventor: Matthew S. Jackson, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 258 days.

(21) Appl. No.: 15/489,175

(22) Filed: Apr. 17, 2017

(65) Prior Publication Data

US 2018/0003013 A1 Jan. 4, 2018

Related U.S. Application Data

(60) Provisional application No. 62/356,974, filed on Jun. 30, 2016.

(51) Int. Cl.

| | |
|---|---|
| ***F04B 47/12*** | (2006.01) |
| ***F04B 53/14*** | (2006.01) |
| ***E21B 37/04*** | (2006.01) |
| ***E21B 43/12*** | (2006.01) |
| ***F04B 53/12*** | (2006.01) |

(52) U.S. Cl.

CPC ..... *E21B 43/121* (2013.01); *F04B 47/12* (2013.01); *F04B 53/126* (2013.01); *F04B 53/14* (2013.01)

(58) Field of Classification Search

None

See application file for complete search history.

(56) References Cited

U.S. PATENT DOCUMENTS

| | | | | |
|---|---|---|---|---|
| 2,661,024 | A | 12/1953 | Knox | |
| 3,183,470 | A | 5/1965 | Hale | |
| 4,007,784 | A | 2/1977 | Watson et al. | |
| 4,410,300 | A | 10/1983 | Yerian | |
| 4,502,843 | A | 3/1985 | Martin | |
| 4,629,004 | A | 12/1986 | Griffin | |
| 4,929,088 | A | 5/1990 | Smith | |
| 5,427,504 | A | 6/1995 | Dinning et al. | |
| 5,752,814 | A * | 5/1998 | Starks | F04B 53/126 417/554 |
| 5,880,552 | A | 3/1999 | McGill et al. | |
| 6,148,923 | A | 11/2000 | Casey | |
| 6,176,309 | B1 | 1/2001 | Bender | |
| 6,200,103 | B1 | 3/2001 | Bender | |

(Continued)

*Primary Examiner* — Matthew R Buck
*Assistant Examiner* — Douglas S Wood
(74) *Attorney, Agent, or Firm* — ExxonMobil Upstream Research Company—Law Department

(57) ABSTRACT

A plunger sleeve for use in an artificial lift system for the production of hydrocarbons which includes an elongate body having an upper end, a lower end, and a central opening through the elongate body. The lower end includes a structural section forming at least a portion of the outer surface of the elongate body and a polymeric section forming at least a portion of an inner surface of the elongate body. At least a portion of the inner surface of the elongate body formed by the polymeric section within the lower end is configured to sealingly conform with a portion of an outer surface of a wellbore sealing device. An artificial lift system including the plunger sleeve and a method of proving artificial lift using the plunger sleeve is described.

25 Claims, 6 Drawing Sheets

(56) References Cited

U.S. PATENT DOCUMENTS

| | | | | |
|---|---|---|---|---|
| 6,209,637 | B1 | 4/2001 | Wells | |
| 6,467,541 | B1 | 10/2002 | Wells | |
| 6,484,971 | B2 | 11/2002 | Layukallo | |
| 6,644,399 | B2 | 11/2003 | Abbott et al. | |
| 6,732,766 | B2 | 5/2004 | Charron | |
| 7,093,652 | B2 | 8/2006 | Gray et al. | |
| 7,121,335 | B2 | 10/2006 | Townsend | |
| 7,243,730 | B2 | 7/2007 | Casey | |
| 7,296,411 | B2 | 11/2007 | Segota et al. | |
| 7,383,878 | B1 | 6/2008 | Victor | |
| 8,181,706 | B2 * | 5/2012 | Tanton | F04B 47/12 166/153 |
| 9,915,133 | B2 * | 3/2018 | Boyd | E21B 43/123 |
| 9,976,548 | B2 * | 5/2018 | Zimmerman, Jr. | E21B 43/121 |
| 10,215,004 | B2 * | 2/2019 | Wilkinson | E21B 43/121 |
| 2005/0022998 | A1 | 2/2005 | Rogers, Jr. | |
| 2007/0001134 | A1 | 1/2007 | Lonnes | |
| 2009/0188673 | A1 | 7/2009 | Hearn et al. | |

* cited by examiner

PLUNGER SLEEVE FOR ARTIFICIAL LIFT SYSTEMS

CROSS REFERENCE TO RELATED APPLICATION

This application claims the benefit of U.S. Provisional Application Ser. No. 62/356,974 filed Jun. 30, 2016, titled "Plunger Sleeve for Artificial Lift Systems", the entirety of which is incorporated by reference herein.

FIELD

The present disclosure relates to a plunger for use in an artificial lift system for the production of hydrocarbons.

BACKGROUND

This section is intended to introduce various aspects of the art, which may be associated with one or more embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Artificial lift is a technique commonly used to remove liquid build-up in aging production wells, thereby increasing the productivity of the well. One form of artificial lift is a plunger lift system, which can be used for gas well dewatering. A plunger lift system can include a plunger sleeve and ball that can freely travel within the wellbore. The wellbore may include a conduit, such as casing, pipe, or tubing. During operation, the plunger sleeve travels between a lubricator proximate the wellhead and a landing bumper disposed within the wellbore distal from the lubricator. When the plunger is positioned at the distal end of the wellbore, the inner surface of the plunger sleeve at the lower end is sealingly conform with the ball forming a metal-to-metal seal allowing liquids to be collected in the conduit above the lower end of the plunger sleeve during production operations. Once the ball and plunger sleeve have sealingly conform with, the natural reservoir pressure begins to build beneath the plunger sleeve. Upon obtaining sufficient pressure in the well, the plunger sleeve, ball and accumulated liquid above the ball and plunger sleeve are lifted to the surface. The liquid is removed from the wellbore, the plunger sleeve is captured by a catcher within the lubricator, and the ball is separated from the plunger sleeve within the lubricator and allowed to fall back towards the bottom of the wellbore. After the ball is decoupled, the catcher of the lubricator releases the plunger sleeve so that the ball and plunger sleeve fall independently. Since the gas within the wellbore has to travel around the outer surface of the ball, the ball falls more slowly than the plunger sleeve which includes a central through bore. Thus, the timing of the release of the plunger sleeve is adjusted to allow the ball to reach the landing bumper before the plunger sleeve. The process is repeated as needed, the plunger sleeve acting as a piston between the liquid and gas in the wellbore.

The force of the multiple impacts between the inner surface of the lower end of the plunger sleeve and the ball on the landing bumper can lead to damage on the plunger sleeve. The damage mechanisms can include deformation, cracking, wear, or a combination thereof proximate the inner surface of the plunger sleeve in contact with the ball. Wear can include abrasion and erosion. Such damage can impact the seal between the plunger sleeve and the ball reducing the effectiveness of the plunger lift system. Additionally, the force of multiple impacts with other surfaces of the plunger sleeve can also lead to damage. Thus, there is a desire to provide a plunger sleeve that reduces the damage to the plunger sleeve.

SUMMARY

This summary is meant to provide an introduction to the various embodiments described herein and is not meant to limit the scope of the claimed subject matter.

An aspect of the present disclosure relates to a plunger sleeve for use in an artificial plunger lift system for the production of hydrocarbons. The plunger sleeve includes an elongate body having an upper end, a lower end, and a central opening through the elongate body. The central opening is formed by the inner surface of the elongated body. The lower end includes a structural section (typically a metal, ceramic, polymeric, or other structure-forming and supporting material) forming at least a portion of the outer surface of the elongate body and a polymeric section forming at least a portion of an inner surface of the elongate body. The polymeric section comprises a polymeric material. At least a portion of the inner surface of the elongate body formed by the polymeric section is configured to sealingly conform with a portion of an outer surface of a wellbore sealing device.

Another aspect of the present disclosure relates to an artificial plunger lift system for the production of hydrocarbons. The artificial plunger lift system includes a plunger sleeve and a wellbore sealing device. The plunger sleeve includes an elongate body having an upper end, a lower end, and a central opening through the elongate body. The central opening is formed by the inner surface of the elongated body. The lower end includes a structural section forming at least a portion of the outer surface of the elongate body and a polymeric section forming at least a portion of an inner surface of the elongate body. The polymeric section comprises a polymeric material. At least a portion of the inner surface of the elongate body formed by the polymeric section sealingly conform to a portion of the outer surface of the wellbore sealing device.

In yet another aspect of the present disclosure relates to a method of providing artificial lift during hydrocarbon production. The method includes lowering a plunger sleeve according to any of the embodiments described herein within a wellbore to sealingly engage a wellbore sealing device; and allowing gas pressure within the wellbore to increase to lift the plunger sleeve, the wellbore sealing device, and liquids contained within the wellbore above the plunger sleeve to a wellhead.

BRIEF DESCRIPTION OF THE DRAWINGS

The foregoing and other advantages of the present disclosure may become apparent upon reading the following detailed description and upon reference to the drawings, in which.

DETAILED DESCRIPTION

Figure 1:
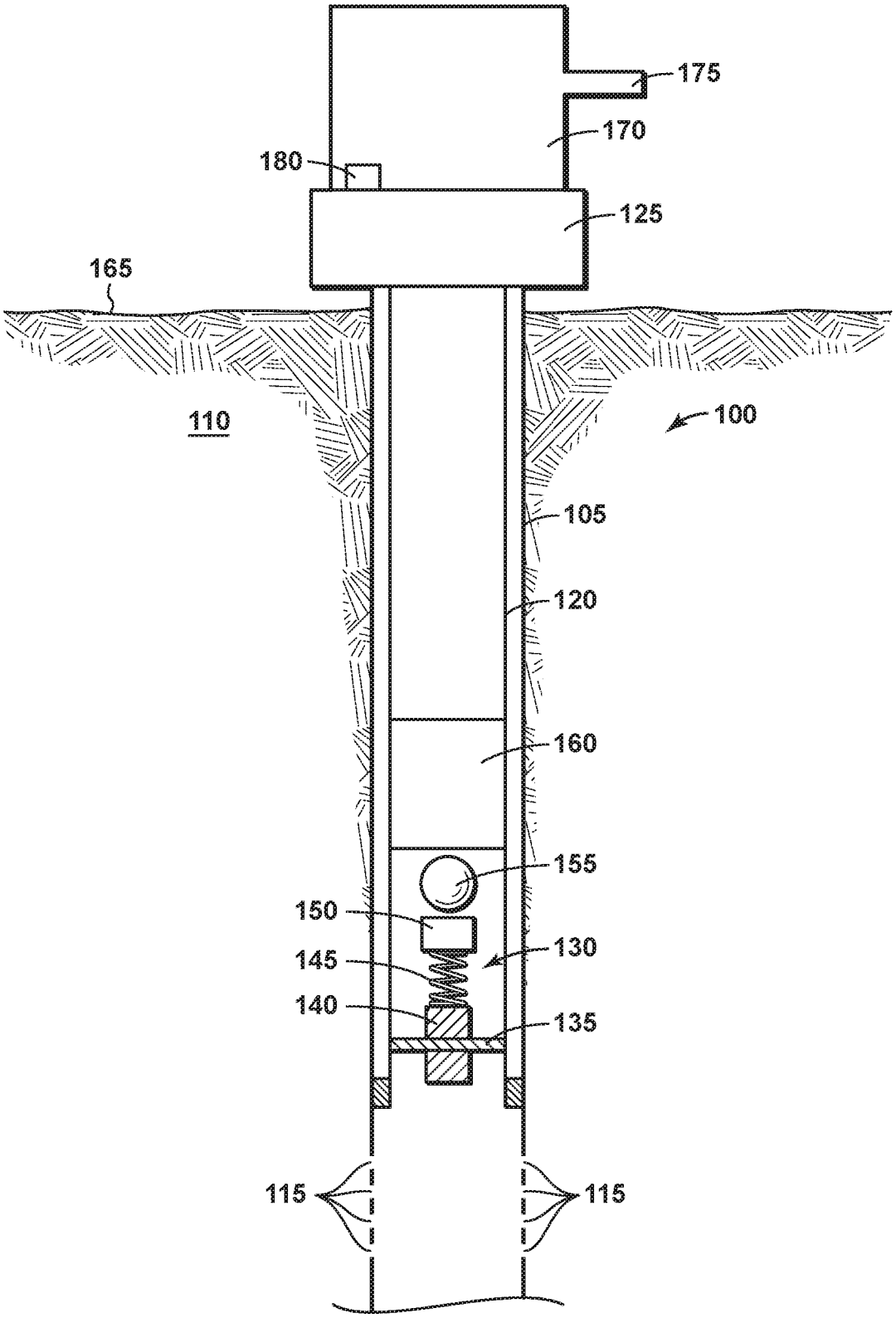
FIG. 1 illustrates an artificial plunger lift system in accordance with one or more embodiments of the present disclosure.

In the following detailed description section, the specific embodiments of the present disclosure are described in connection with one or more embodiments. However, to the extent that the following description is specific to a particular embodiment or a particular use of the present disclosure, this is intended to be for exemplary purposes only and simply provides a description of the one or more embodiments. Accordingly, the disclosure is not limited to the specific embodiments described below, but rather, it includes all alternatives, modifications, and equivalents falling within the true spirit and scope of the appended claims.

Various terms as used herein are defined below. To the extent a term used in a claim is not defined below, it should be given the broadest definition persons in the pertinent art have given that term as reflected in at least one printed publication or issued patent.

Certain terms are used throughout the following description and claims to refer to particular features or components. As one skilled in the art would appreciate, different persons may refer to the same feature or component by different names. This document does not intend to distinguish between components or features that differ in name only. The drawing figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, quantities, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of 1 to 4.5 should be interpreted to include not only the explicitly recited limits of 1 to 4.5, but also to include individual numerals such as 2, 3, 4, and sub-ranges such as 1 to 3, 2 to 4, etc. The same principle applies to ranges reciting only one numerical value, such as "at most 4.5", which should be interpreted to include all of the above-recited values and ranges. Further, such an interpretation should apply regardless of the breadth of the range or the characteristic being described.

The term "lubricator" as used herein is meant to include a high pressure conduit in fluid communication with the wellhead and arranged to receive the plunger sleeve. The lubricator may include a catcher, a decoupler to separate the plunger sleeve and the wellbore sealing device, and an energy absorption element, such as a spring, to protect the plunger sleeve when traveling from within the wellbore into the lubricator. The lubricator may also include one or more sensors, for example a sensor to detect the presence of the plunger sleeve within the lubricator. To introduce the plunger sleeve and wellbore sealing device into the wellbore, a valve within the wellhead in fluid communication with the lubricator is closed and the plunger sleeve or wellbore sealing device may be placed within the lubricator. The lubricator is then pressurized to wellbore pressure and the valve opened to allow the plunger sleeve or wellbore sealing device to enter into the wellbore. The process would be reversed to remove the plunger sleeve from the lubricator.

The term "hydrocarbons" as used herein is meant to refer to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15.deg. C. and 1 atm pressure). Hydrocarbon fluids may include, for example, oil, natural gas, coal bed methane, shale oil, and other hydrocarbons that are in a gaseous or liquid state.

The term "wellbore" as used herein is meant to refer to an opening or hole in the subsurface made by drilling or insertion of a conduit into the subsurface. A wellbore may have a substantially circular cross section, or other cross-sectional shape.

The term "subsurface" as used herein is meant to refer to geologic strata occurring below the earth's surface.

FIG. 1 illustrates an artificial plunger lift system 100 for the production of hydrocarbons in accordance with one or more embodiments of the present disclosure. As illustrated, casing string 105 is disposed within an earthen formation 110. The casing string 105 includes a plurality of perforations 115 for production of hydrocarbons from the reservoir. Within the interior of the casing string, a conduit 120, for example production tubing, is disposed extending from the lubricator 170 through the wellhead 125 to a location above the perforations 115. A landing bumper 130 is disposed within the conduit 120. A support 135 centers the landing bumper 130 within the conduit 120. The landing bumper includes a base 140, a spring 145, and a receiver 150 for the wellbore sealing device 155. The wellbore sealing device 155 depicted in FIG. 1 is a ball. Also disposed within the conduit 120 is a plunger sleeve 160. The wellhead 125 is positioned at the surface 165 of the earthen formation 110. A lubricator 170 is positioned proximate the wellhead 125, for example above the wellhead, and is in fluid communication with the wellhead. The lubricator 170 includes a plunger sleeve catcher 175 and a decoupler 180 configured to break the seal between the outer surface of the wellbore sealing device and the inner surface of the plunger sleeve 160 at the lower end. Although the landing bumper 130 is depicted as including a base 140, a spring 145, and a receiver 150, any suitable arrangement may be used to receive the wellbore sealing device.

Figure 2:
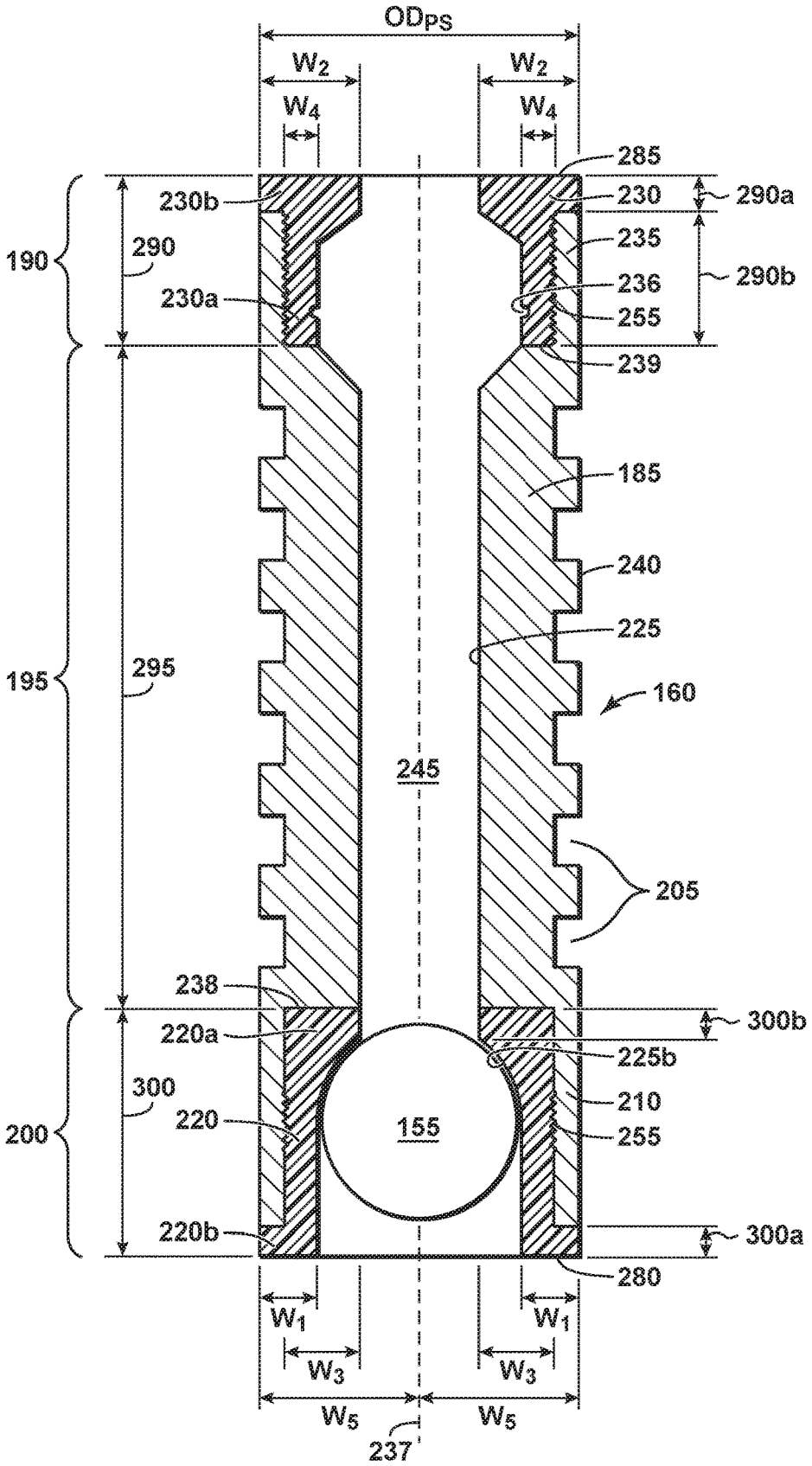
FIG. 2 illustrates a plunger sleeve and wellbore sealing device in accordance with one or more embodiments of the present disclosure.

As illustrated in FIG. 1, the wellbore sealing device (e.g., a ball) 155 and the plunger sleeve 160 are sized and positioned to move freely within the conduit 120 between the landing bumper 130 and the lubricator 170. FIG. 2 illustrates the plunger sleeve 160 and the ball wellbore sealing device 155 in accordance with one or more embodiments of the present disclosure. The plunger sleeve 160 has an upper end 190, a lower end 200, and a midsection 195. The plunger sleeve 160 has a longitudinal axis 237. The upper end 190 extends a longitudinal (or axial) length 290 of the plunger sleeve 160 and includes the end surface 285. The lower end 200 extends a longitudinal length 300 of the plunger sleeve 160 and includes end surface 280. The longitudinal length 290 of the upper section 190 may be the same as or different than the longitudinal length 300 of the lower section 200. In one or more embodiments, the total longitudinal length of 290 and 300 is less than the longitudinal length 295 of the midsection 195 of the plunger sleeve 160.

The inner surface 225 of the plunger sleeve 160 forms a central opening 245 extending through the plunger sleeve 160. The outer surface 240 of the midsection 195 has a plurality of grooves 205 to create a pressure differential assisting with the artificial lift. Although not shown, the outer surface 240 of the midsection 195 may alternatively have two or more pads disposed circumferentially around the plunger sleeve body, extending radially outward and along a portion of the longitudinal length of the plunger sleeve body. In one or more embodiments, the outer surface 240 of the plunger sleeve 160 and/or the two or more pads disposed around the plunger sleeve body may include a wear resistant coating or material.

In other embodiments, the outer surface 240 of the midsection 195 of the elongate plunger sleeve body 185 may include one or more brush elements (not shown) disposed thereon and extending radially outward towards the inner surface (inner diameter) of the conduit 120. The brush elements may include a plurality of brush wires configured to maintain a superior seal, prevent pressure loss, and reduce the pressure required to lift the plunger sleeve to the surface as well as clean the inner surface of the conduit 120.

As illustrated in FIG. 2, the lower end 200 of the plunger sleeve 160 has a structural section 210 and a polymeric section 220. The polymeric section 220 is a separate section of the plunger sleeve body 185 and comprises a polymeric material that is attached to the structural section 210 using a threaded connection 255 between a portion of the inner surface of the structural section 210 and the outer surface of the polymeric section 220.

Figure 4:
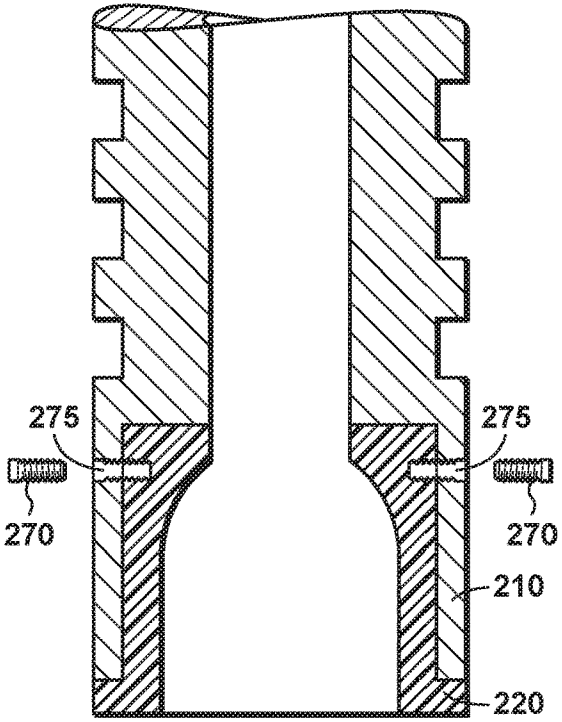
FIG. 4 illustrates a plunger sleeve in accordance with one or more embodiments of the present disclosure.
Figure 3:
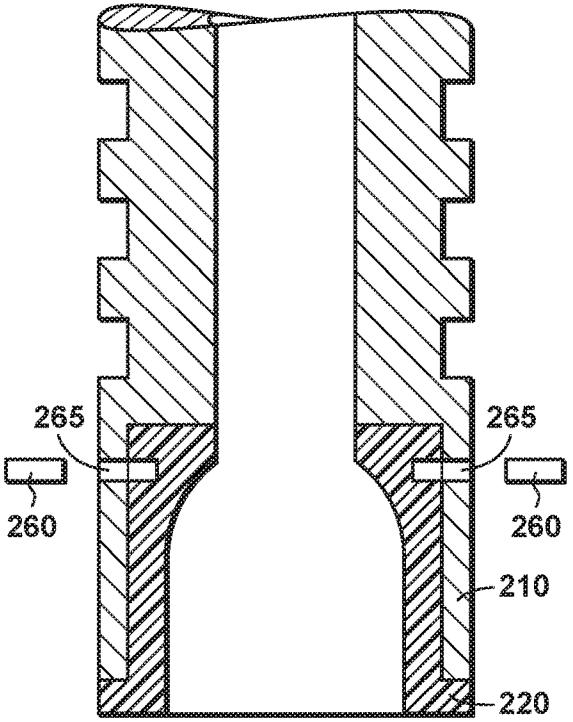
FIG. 3 illustrates a plunger sleeve in accordance with one or more embodiments of the present disclosure.

Other mechanical elements may be used alternatively or additionally to attach the polymeric section 220 to the structural section 210. As shown in FIG. 3, a pin 260 may be disposed within an opening 265 radially extending through the structural section 210 and at least partially into the polymeric section 220. Any number of pins 260 may be used to attach the polymeric section 220 to the structural section 210, for example at least two pins, at least three pins, or at least four pins. As shown in FIG. 4, a set screw 270 may be disposed within an opening 275 radially extending through the structural section 210 and at least partially into the polymeric section 220. Any number of screws 270 may be used to attach the polymeric section 220 to the structural section 210, for example at least two screws, at least three screws, or at least four screws. Although not shown, mechanical attachment may include an interference fit between the structural section 210 and the polymeric section 220. Further, an adhesive (not shown) may be used alternatively or additionally with a mechanical element to attach the polymeric section 220 to the structural section 210.

Referring to FIG. 2, the polymeric section 220 includes a first region 220*a* and a second region 220*b*. The first region 220*a* is disposed radially interior of the structural section 210. The second region 220*b* forms the end surface 280 of the lower end 200 and extends between the outer surface 240 and the inner surface 225 of the plunger sleeve 160. The upper end 190 of the plunger sleeve 160 also has a structural section 235 and a polymeric section 230. The polymeric section 230 is a separate section of the plunger sleeve body 185 and comprises a polymeric material that is attached to the structural section 235 using a threaded connection 255 between a portion of the inner surface of the structural section 235 and the outer surface of the polymeric section 230. Although not shown, the other attachment arrangements described for the lower end 200 may be used alternatively or additionally to attach the polymeric section 230 to the structural section 235 of the upper end 190. The inner surface of the polymeric section 230 forms a portion of the inner surface 225 of the plunger sleeve 160. Polymeric section 230 includes a first region 230*a* and a second region 230*b*. The first region 230*a* is disposed radially interior of the structural section 235 and includes a groove 236 for fishing the plunger sleeve body 160 from the wellbore. The second region 230*b* forms end surface 285 of the upper end 190 and extends between the outer surface 240 and the inner surface 225 of the plunger sleeve 160.

The lower end 200 of the plunger sleeve 160 has a total radial width $w_5$ (radius), as shown in FIG. 2. The end surface 280 has a radial width $w_1$ and the first region 220*a* has a maximum radial width $w_3$. The end surface 285 has a radial width $w_2$ and the first region 230*a* has a radial width $w_4$. The first region 220*a* has a longitudinal length 300*b* along the inner surface 225 of the plunger sleeve body 160 extending between the uppermost portion of the inner sealing surface and the upper surface 238 of the first region 220*a* and the second region 220*b* has a longitudinal length 300*a* along the outer surface 240 of the plunger sleeve body 160 extending from the end surface 280 of the lower end 200. With respect to the upper end 190, the second region 230*b* has a longitudinal length 290*a* along the outer surface 240 of the plunger sleeve body 160 extending from the end surface 285 of the upper end 190 and the first region 230*a* has a longitudinal length 290*b* constituting the remainder of the longitudinal length of polymeric section 230 extending to the lower surface 239 of the first region 230*a* of the upper end 190.

Figure 8:
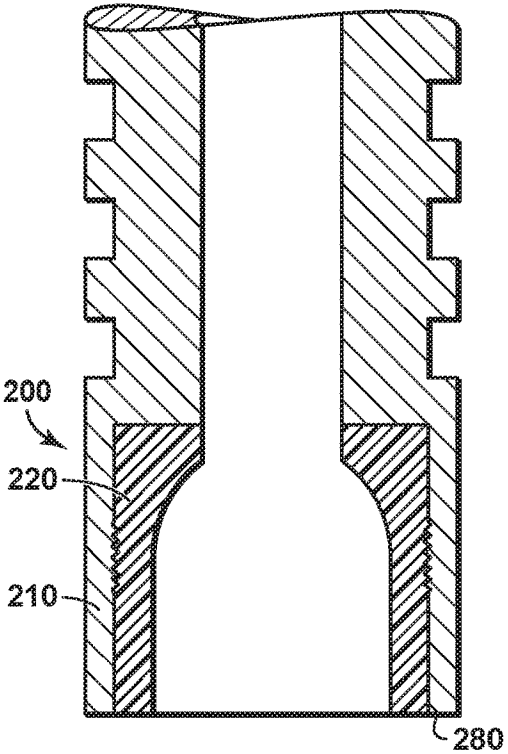
FIG. 8 illustrates a plunger sleeve in accordance with one or more embodiments of the present disclosure.

FIG. 8 illustrates a lower end 200 in which the structural section 210 extends the longitudinal length of the outer surface of the lower end 200 and forms a portion of the end surface 280 radially exterior of the polymeric section 220 which forms the remaining portion of the end surface 280 radially interior of the structural section 210.

The polymeric material of polymeric sections 220, 230 may be any suitable polymeric material capable of withstanding the artificial lift conditions within the wellbore, for example the polymeric material may be selected from polyethylene, polypropylene, polybutylene, polyvinyl chloride, polytetrafluoroethylene (PTFE), polychlorotrifluoroethylene, polystyrene, acrylonitrile-butadiene-styrene, and combinations thereof. In one or more embodiments, the polymeric material may be a high density polyethylene material having a density in the range of from 0.941 to 0.965 grams per cubic centimeter (g/cc), measured according to ASTM D 1505. In one or more other embodiments, the polymeric material may be an ultra-high density polyethylene material having a density greater than 0.965 g/cc, measured according to ASTM D 1505. In one or more other embodiments, the polymeric material may be an ultra-high molecular weight polyethylene material having a molecular weight of at least one million atomic mass units (amu) or greater than two million amu or greater than three million amu. In one or more embodiments, the ultra-high molecular weight polyethylene material may have a molecular weight in the range of from 3.5 million amu to 7.5 million amu. Ultra-high density polyethylene materials and ultra-high molecular weight polyethylene materials can provide high wear resistance, a low coefficient of friction, and high impact resistance.

The polymeric material may be a composite material including a reinforcement component. The reinforcement component may be, for example, a fiber material or a metal insert. A plurality of reinforcement components may be spaced apart circumferentially, or spaced apart longitudinally, or a combination thereof.

The structural sections 210, 235 and the plunger sleeve body 185 in the midsection 195 are made of a rigid or structurally formable material (typically, for example, a metal, ceramic, polymeric, or other shapeable, structure-forming and supporting material). The structural material may be any suitable rigid or semi-rigid, formable material capable of supporting the seals and components thereon and withstanding the artificial lift conditions within the wellbore (e.g., corrosiveness, bottomhole temperature, etc.), for example a steel such as a stainless steel, a carbon steel, or an alloy steel such as a chromium-molybdenum steel (e.g., 4140 alloy steel), or a ceramic material. Thermoplastic or other polymeric materials may also have suitability and cost-effectiveness in some applications.

The inner surface 225*b* of the first region 220*a* of the polymeric section 220 forms a portion of the inner surface 225 of the plunger sleeve 160. The inner surface 225*b* forms at least the entire inner surface of the plunger sleeve 160 which is in contact with the outer surface of the wellbore sealing device 155 when sealingly conform with the plunger sleeve 160. As discussed herein, the metal-to-metal contact of a conventional plunger lift system leads to damage (plastic deformation, cracking, wear, or a combination thereof), especially at the lower end of the plunger sleeve. By using a polymeric material for the contact surface of the plunger sleeve with the wellbore sealing device, damage can be reduced resulting in an improved service life for the plunger sleeve. Using the polymeric material for all or a portion of the end surface(s) can also reduce damage from contact with the end surface(s) also improving service life for the plunger sleeve. Also, the term "seal" or "sealingly," or the like merely refers to the ability of the seal to move toward the tubular body within which the device travels, so as to cause fluid above the plunger to be lifted by the device toward the surface, without an undesirable amount of fluid slippage or leakage past the plunger seals during plunger travel toward the surface. It is understood that in differing applications the "seal" or conformance of the seal elements with or to the tubular body will permit more fluid slippage than other applications and that at times the seal elements may actually touch the tubular wall or a small gap may be desired, and may vary along the length of the wellbore tubular.

In one or more embodiments, the longitudinal length (290+295+300) of the elongate body of the plunger sleeve may be any suitable length, for example in the range of from 15 centimeters (cm) to 45 cm, such as 20 cm, 25 cm, 30 cm or 40 cm. In one or more embodiments, the maximum outer diameter of the plunger sleeve ($OD_{ps}$) may be any suitable diameter, for example in the range of from 5 cm to 15 cm or 7 cm to 10 cm. In one or more embodiments, the minimum thickness of the polymeric section (measured inward, perpendicular to the surface of the polymeric section) in contact with the wellbore sealing device and/or at the end surface(s) may be at least 0.1, at least 0.25 cm, at least 0.3 cm, at least 0.4 cm, or at least 0.5 cm thick.

In one or more embodiments, the maximum longitudinal length of the polymeric section along the outer surface of the plunger sleeve body extending from the end surface of the lower end may be at most the radial width $w_1$ of the end surface (e.g., length 300*a*≤width $w_1$). In one or more embodiments, the maximum longitudinal length of the polymeric section along the outer surface of the plunger sleeve body extending from the end surface of the upper end may be at most the radial width $w_2$ of the end surface (e.g., length 290*a*≤width $w_2$). In one or more embodiments, the longitudinal length of the polymeric section along the outer surface of the plunger sleeve body extending from the end surface of the lower end may be substantially the same length as the longitudinal length of the polymeric section along the outer surface of the plunger sleeve body extending from the end surface of the upper end (e.g., 300*a*=290*a*).

In one or more embodiments, the maximum longitudinal length of the polymeric section along the inner surface of the plunger sleeve body of the lower end extending between the uppermost portion of the inner sealing surface and the upper surface of polymeric section of the lower end may be at most the radial width $w_1$ of the end surface or at most two-thirds the radial width $w_1$ (e.g., 300*b*≤$w_1$ or 300*b*≤⅔$w_1$). In one or more embodiments, the maximum longitudinal length of the polymeric section along the inner surface of the plunger sleeve body of the lower end extending between the uppermost portion of the inner sealing surface and the upper surface of polymeric section of the lower end may be at most the maximum longitudinal length of the polymeric section along the outer surface of the plunger sleeve body of the lower end extending from the end surface of polymeric section (e.g., 300*a*≥300*b*).

In one or more embodiments, the maximum longitudinal length of the polymeric section along the inner surface of the plunger sleeve body of the lower end extending between the uppermost portion of the inner sealing surface and the upper surface of polymeric section of the lower end may be substantially the same length as the maximum longitudinal length of the polymeric section along the outer surface of the plunger sleeve body of the lower end extending from the end surface of polymeric section (e.g., 300*a*=300*b*).

By limiting the maximum longitudinal lengths of a polymeric section along the inner surface between the uppermost portion of the inner sealing surface and the upper surface of polymeric section of the lower end and the outer surface extending from an end surface of the plunger sleeve body can minimize radial deformation upon contact with an object.

In one or more embodiments, the maximum radial width $w_3$ for the region of the polymeric section of the lower end extending between the uppermost portion of the inner sealing surface and the upper surface of polymeric section may be at most two-thirds of the radial width of the end face of the lower end (e.g., $w_3$≤⅔$w_1$).

Figure 5:
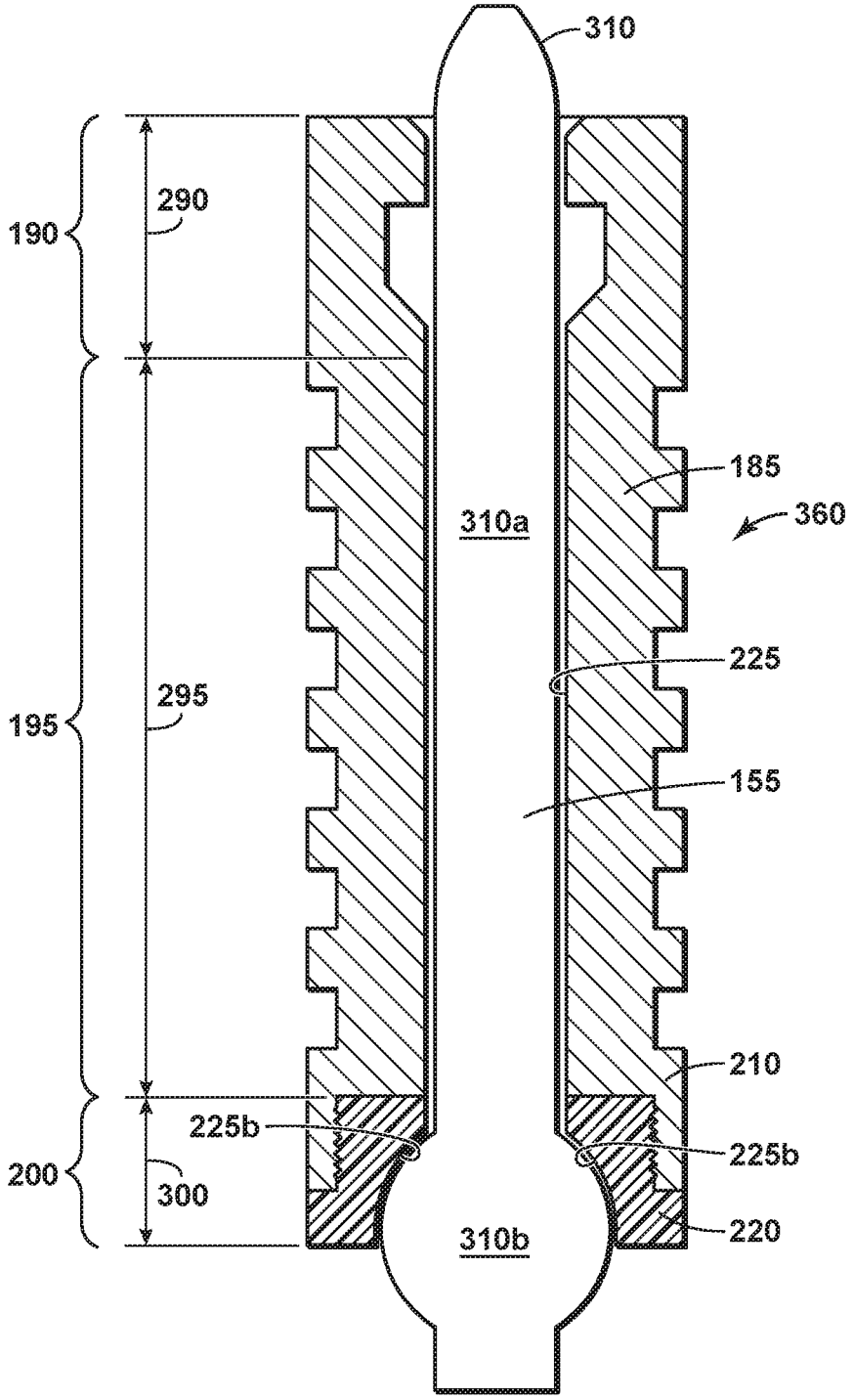
FIG. 5 illustrates a plunger sleeve and a wellbore sealing device in accordance with one or more embodiments of the present disclosure.

FIG. 5 illustrates a plunger sleeve 360 and a valve element 310 as the wellbore sealing device 155 in accordance with one or more embodiments of the present disclosure. The plunger sleeve 360 is similar to the plunger sleeve 160 of FIG. 2; however, the upper end 190 does not include a polymeric section 230. The valve element 310 is disposed with the central opening of the plunger sleeve 360 and extends the longitudinal length of the plunger sleeve 360. The valve element 310 has an elongated section 310*a* and a spherical section 310*b*. The inner surface 225*b* of polymeric section 220 forms the entire inner surface of the plunger sleeve 360 which is in contact with the outer spherical surface of the valve element 310 in the spherical section 310*b* when sealingly conform with the plunger sleeve 360.

Although the wellbore sealing device has been depicted herein as a ball or a valve element, the wellbore sealing device may be any suitable arrangement having a portion of the outer surface shaped to sealingly engage with a portion of the inner surface of the plunger sleeve in the polymeric section at the lower end. In one or more embodiments, the sealing surfaces are smooth, curved, correspondingly-shaped surfaces.

Figure 6D:
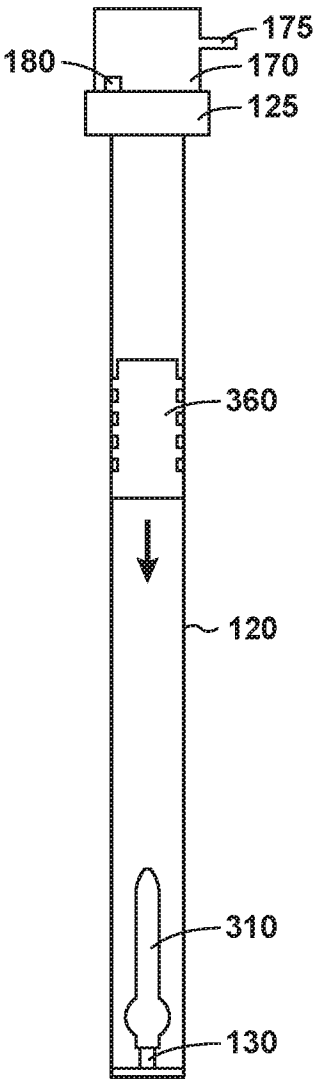
FIGS. 6A-6D illustrate a method of providing artificial lift during hydrocarbon production in accordance with one or more embodiments of the present disclosure.
Figure 6C:
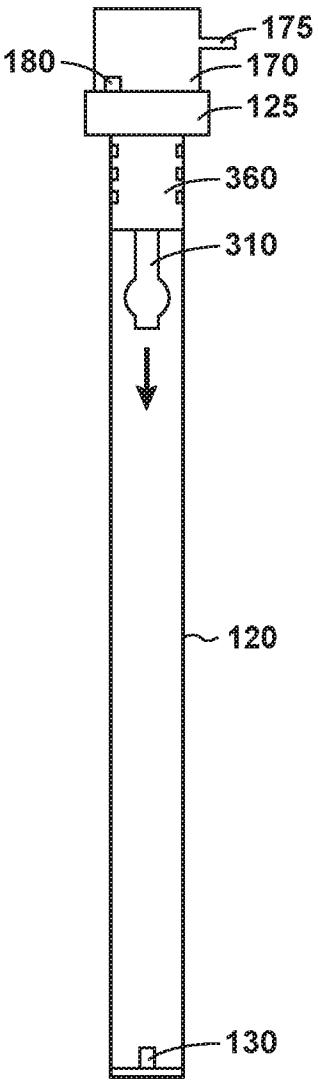
Figure 6B:
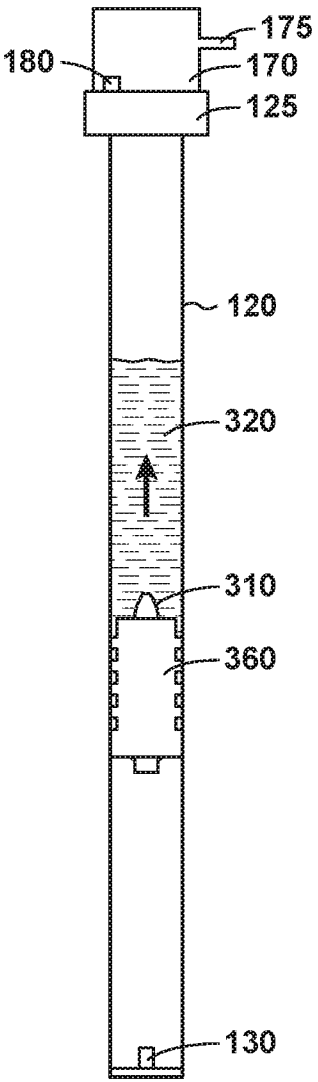
Figure 6A:
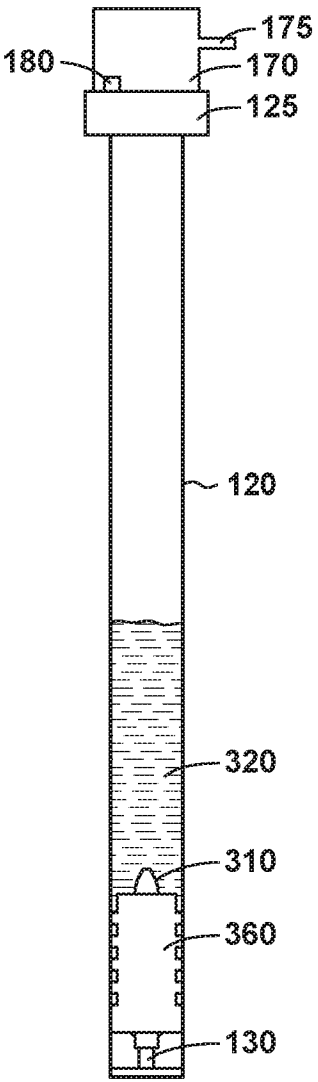

FIG. 6A-6D illustrate a method of providing artificial lift during hydrocarbon production in accordance with one or more embodiments of the present disclosure. FIGS. 6A-6D are a partial depiction of the wellbore illustrating the portion of conduit 120 extending between the landing bumper 130 and the wellhead 125. FIG. 6A depicts the plunger sleeve 360 and valve element 310 having been lowered within the wellbore (not shown) and positioned at the bottom of the conduit 120 adjacent the landing bumper 130 with liquid 320 collected above the plunger sleeve 360 and valve element 310. FIG. 6B depicts the plunger sleeve 360 and valve element 310 in sealing engagement, with the liquid 320 above, being lifted within the conduit 120 towards the wellhead 125. FIG. 6C depicts the plunger sleeve 360 retained within the lubricator 170 by engaging the plunger sleeve catcher 175, and the valve element 310 decoupled from the plunger sleeve 360 using the decoupler 180 and traveling downward in the conduit 120. FIG. 6D depicts the valve element 310 positioned on the landing bumper 130 and the plunger sleeve 360 released from the plunger sleeve catcher 175 and traveling downward in the conduit 120.

Figure 7:
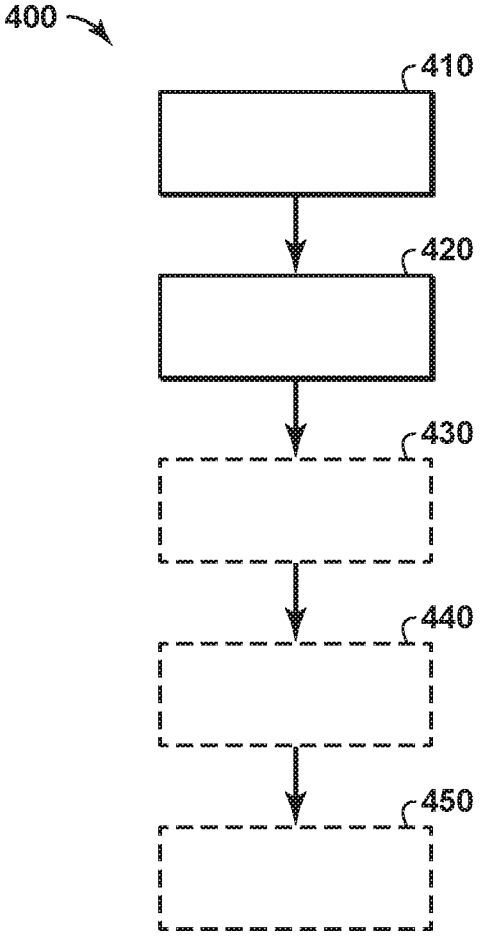
FIG. 7 illustrates a flow chart for a method of providing artificial lift during hydrocarbon production in accordance with one or more embodiments of the present disclosure.

FIG. 7 illustrates a flow chart for a method 400 of providing artificial lift during hydrocarbon production in accordance with one or more embodiments of the present disclosure. At block 410, a plunger sleeve is lowered within a wellbore to sealingly engage a wellbore sealing device which has been previously lowered into the wellbore. Liquids are allowed to collect within the wellbore above the plunger sleeve and the wellbore sealing device. At block 420, the pressure within the wellbore is allowed to increase to a pressure sufficient to lift the plunger sleeve, the wellbore sealing device, and the liquids contained within the wellbore above the plunger sleeve and wellbore sealing device up to a wellhead. At block 430, the upper end of the plunger sleeve is caught by within a lubricator proximate the wellhead. At block 440, the wellbore sealing device is decoupled from the lower end of the plunger sleeve allowing the wellbore sealing device to travel downward within the wellbore and come to rest on the landing bumper. At block 450, the plunger sleeve is released from the lubricator and the plunger sleeve is again lowered within the wellbore to sealingly engage the wellbore sealing device and the artificial lift process repeated. It is understood that blocks denoted with dashed lines indicate optional steps which may be performed.

Although the use of the plunger sleeve has been described in the present disclosure with respect to unloading liquids from gas wells that continue to load the wellbore, the plunger sleeve may be used in other applications. Other applications may include a bypass plunger lift arrangement; increasing the production of oil producing wellbores when the bottomhole pressure is insufficient to support fluid flow to the surface; minimizing liquid fallback to the bottom of the wellbore and reducing the possibility of gas penetration through a liquid slug; and cleaning the inner diameter of a wellbore conduit having wax or other solids deposited thereon.

It should be understood that the preceding is merely a detailed description of specific embodiments of the invention and that numerous changes, modifications, and alternatives to the disclosed embodiments can be made in accordance with the disclosure without departing from the scope of the invention. The preceding description, therefore, is not meant to limit the scope of the invention. Rather, the scope of the invention is to be determined only by the appended claims and their equivalents. The articles "the", "a" and "an" are not necessarily limited to mean only one, but rather are inclusive and open-ended so as to include, optionally, multiple such elements.

What is claimed is:

1. A plunger sleeve for use in an artificial plunger lift system for the production of hydrocarbons comprising:

an elongate body comprising;

an upper end, a lower end comprising a structural section forming at least a portion of an outer surface of the elongate body and an attached polymeric section, the polymeric section (i) forming at least a portion of an inner surface of the elongate body and (ii) providing an impact surface on the lower end of the elongate body, and a central opening through the elongate body and the polymeric section for fluid flow through the elongate body, the central opening formed by the inner surface of the elongate body and the polymeric section, wherein the polymeric section comprises a polymeric material and at least a portion of the inner surface of the elongate body formed by the polymeric section is configured to sealingly conform with a portion of an outer surface of a central opening sealing device, and wherein at least a portion of the impact surface on the lower end of the elongate body extends axially past a lower end of the elongate body structural section providing the impact surface as a lower-most end of the lower end of the elongate body.

2. The plunger sleeve of claim 1, wherein the polymeric material is selected from the group consisting of polyethylene, polypropylene, polybutylene, polyvinyl chloride, polytetrafluoroethylene, polychlorotrifluoroethylene, polystyrene, acrylonitrile-butadiene-styrene, and combinations thereof.

3. The plunger sleeve of claim 1, wherein the polymeric material is an ultra-high molecular weight polyethylene material having a molecular weight of at least three million amu.

4. The plunger sleeve of claim 1, wherein the polymeric material is an ultra-high density polyethylene material having a density of greater than 0.965 grams per cubic centimeter, measured according to ASTM D 1505.

5. The plunger sleeve of claim 1, wherein the polymeric material includes a reinforcement component.

6. The plunger sleeve of claim 5, wherein the reinforcement component is a fiber material.

7. The plunger sleeve of claim 1, wherein the structural section is connected to the polymeric section by an adhesive material.

8. The plunger sleeve of claim 1, wherein the structural section is connected to the polymeric section by a mechanical element selected from the group consisting of a threaded connection, pins, screws, interference fit, and combinations thereof.

9. The plunger sleeve of claim 1, wherein the polymeric section has a first region disposed radially interior of the structural section and a second region forming an end surface of the lower end extending between the outer surface and the inner surface of the elongate body.

10. The plunger sleeve of claim 1, wherein the upper end comprises a structural section and a polymeric section, the polymeric section comprising a polymeric material and forming at least a portion of the inner surface of the elongate body within the upper end.

11. The plunger sleeve of claim 10, wherein the polymeric section of the upper end has a first region disposed radially interior of the structural section and a second region forming an end surface of the upper end extending between the outer surface and the inner surface of the elongate body.

12. The plunger sleeve of claim 1, wherein the wellbore sealing device is a ball.

13. An artificial plunger lift system for the production of hydrocarbons comprising:

a plunger sleeve comprising:

an elongate body including:

an upper end, a lower end comprising a structural section forming at least a portion of an outer surface of the elongate body and an attached polymeric section, the polymeric section (i) forming at least a portion of an inner surface of the elongate body and (ii) providing an impact surface on the lower end of the elongate body, a polymeric section forming at least (i) a portion of an inner surface of the structural section of the elongate body, and (ii) an impact resistance surface covering a lower-most end of the structural section of the elongate body, and a central opening through the elongate body and the polymeric section for fluid flow through the elongate body, the central opening formed by the inner surface of the elongate body and the polymeric section, wherein the polymeric section comprises a polymeric material and at least a portion of the inner surface of the elongate body formed by the polymeric section is configured to sealingly conform with a portion of an outer surface of a central opening sealing device, and wherein at least a portion of the impact surface on the lower end of the elongate body extends axially past a lower end of the elongate body structural section providing the impact surface as a lower-most end of the lower end of the elongate body; and a wellbore sealing device having an outer surface for sealingly engaging a sealing surface in the polymeric section.

14. The system of claim 13, wherein the polymeric material is selected from the group consisting of polyethylene, polypropylene, polybutylene, polyvinyl chloride, polytetrafluoroethylene, polychlorotrifluoroethylene, polystyrene, acrylonitrile-butadiene-styrene, and combinations thereof.

15. The system of claim 13, wherein the polymeric material is an ultra-high molecular weight polyethylene material having a molecular weight of at least three million amu.

16. The system of claim 13, wherein the polymeric material is an ultra-high density polyethylene material having a density of greater than 0.965 grams per cubic centimeter, measured according to ASTM D 1505.

17. The system of claim 13, wherein the polymeric material includes a reinforcement component.

18. The system of claim 17, wherein the reinforcement component is a fiber material.

19. The system of claim 13, wherein the structural section is connected to the polymeric section by an adhesive material.

20. The system of claim 13, wherein the polymeric section is connected to the structural section by a mechanical element selected from the group consisting of a threaded connection, pins, screws, interference fit, and combinations thereof.

21. The system of claim 13, wherein the polymeric section has a first region disposed radially interior of the structural section and a second region forming an end surface of the lower end extending between the outer surface and the inner surface of the elongate body.

22. The system of claim 13, wherein the upper end comprises a structural section and a polymeric section, the polymeric section comprising a polymeric material and forming at least a portion of the inner surface of the elongate body within the upper end.

23. The system of claim 13, wherein the polymeric section of the upper end has a first region disposed radially interior of the structural section and a second region forming an end surface of the upper end extending between the outer surface and the inner surface of the elongate body.

24. The system of claim 13, wherein the wellbore sealing device is a ball.

25. A method of providing artificial lift during hydrocarbon production comprising:

lowering a plunger sleeve system according to claim 13 within a wellbore to sealingly conform with a wellbore sealing device;

allowing fluid pressure within the wellbore to increase to seat the central opening sealing device with the polymeric section and lift the plunger sleeve, the wellbore sealing device, and liquids contained within the wellbore above the plunger sleeve to a wellhead; and allowing the central opening sealing device to disengage from the polymeric section and fall through the wellbore to a lower end of the wellbore proximate the stop surface for the elongate body in the lower end of the wellbore and allowing the elongate body to fall through the wellbore until the impact surface impacts the stop surface for the elongate body and reengages the central opening sealing device with the polymeric section.

* * * * *